United States Patent [19]

Kaminstein

[11] Patent Number: 4,569,467

[45] Date of Patent: Feb. 11, 1986

[54] DISPENSER FOR AUTOMATICALLY ADVANCING A LENGTH OF WEB

[76] Inventor: Bernard Kaminstein, 29 Third Ave., New York, N.Y. 10003

[21] Appl. No.: 586,424

[22] Filed: Mar. 5, 1984

[51] Int. Cl.[4] ..... B26F 3/02

[52] U.S. Cl. ..... 225/106; 83/209; 83/364; 83/367; 225/11; 242/55.54

[58] Field of Search ..... 225/10, 11, 106; 242/55.54, 55.42; 83/364, 367, 209

[56] References Cited

U.S. PATENT DOCUMENTS

| | | | |
|---|---|---|---|
| 1,518,749 | 12/1924 | Nelson | 242/55.54 |
| 3,837,549 | 9/1974 | Sengewald | 225/11 |
| 3,949,918 | 4/1976 | Golner et al. | 225/11 |

*Primary Examiner*—Frank T. Yost
*Attorney, Agent, or Firm*—Stephen E. Feldman

[57] ABSTRACT

A lazy-susan type roll table supports, in a vertical position, a roll of place mats interconnected into a continuous web (i.e. each mat is attached to its adjacent mat by perforations and all are rolled up on a core to form the roll of material). A web feed roller, also disposed for rotation about a vertical axis, is spaced from the roll table and cooperates with a pinch roller to grip therebetween the web of place mats and to feed the place mats along a path. An end panel positioning plate receives the end place mat, as the web is being fed, and carries an infra-red sensor which responds to the presence of the perforations between the mats to terminate drive of the web feed roller. A web tension drive extends up through the core of the roll of place mats and mounts a soft rubber drive wheel which when driven urges the web roll in a direction opposite to that imparted to the web by the web feed roller. Control circuitry actuates the tension drive when web feed drive terminates to apply tension to the web and facilitate severing of the end place mat, from the other place mats, along the perforations when the end place mat is positioned at the end panel. The end panel also carries a micro-switch which senses the absence of the just separated end place mat to terminate power to the tension drive and start web feed drive to repeat the process of positioning a place mat at the end panel. A jogging switch is provided to facilitate short web advancing operations of the web feed and an oscillator is provided to adjust the length of advance of the web to thereby compensate for different size place mats.

17 Claims, 7 Drawing Figures

FIG. 5
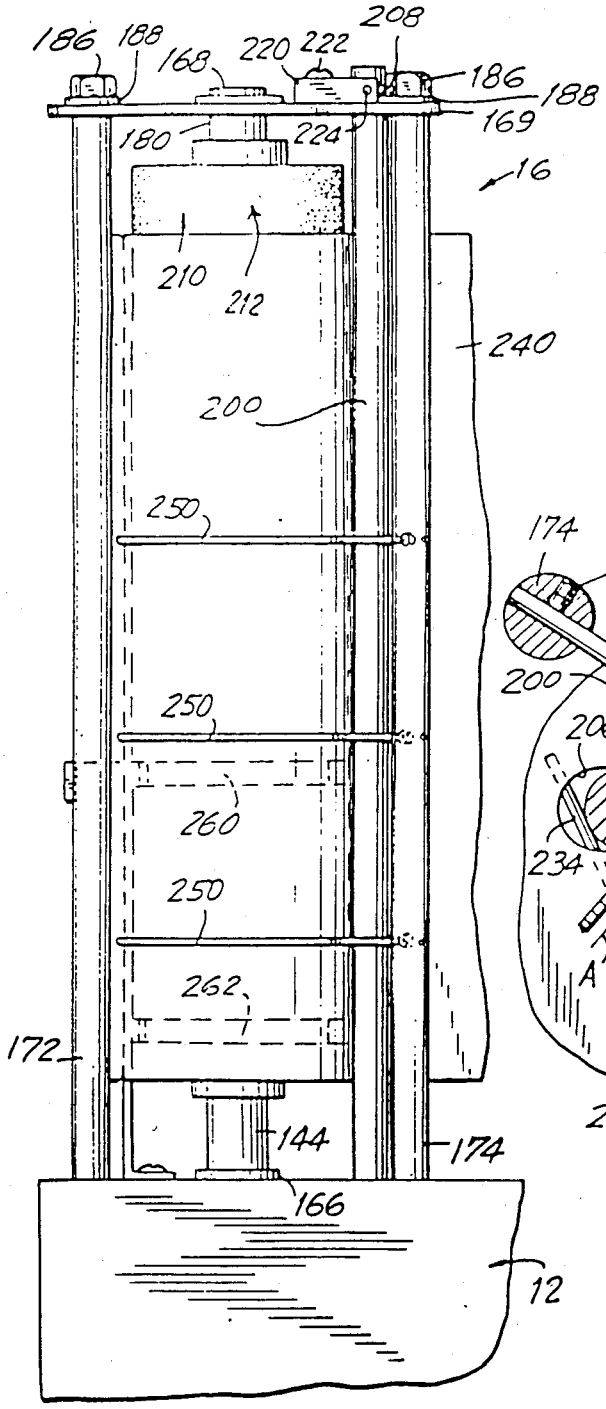
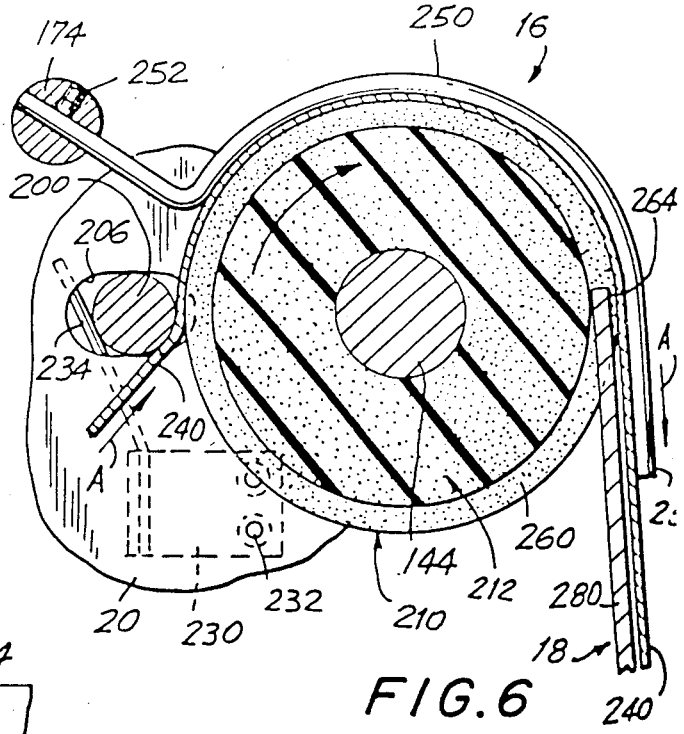
FIG. 6

DISPENSER FOR AUTOMATICALLY ADVANCING A LENGTH OF WEB

BACKGROUND OF THE INVENTION

1. Field of Application

This invention relates to article dispensers; and more particularly to dispensers for discrete sheet-like articles.

BACKGROUND OF THE INVENTION

1. Description of the Prior Art

There are many types of article dispensers; probably as many as the types of articles that are to be dispensed. Some article dispensers are quite simple and take the form of a container or holder which positions the articles to be dispensed for hand withdrawal from the container in single or multiple quantities. Other dispensers are extremely complex and automatically dispense one or more articles in response to actuation of an appropriate control which may be operator or coin actuated.

Each particular article to be dispensed involves its own peculiarities depending upon its shape (box, cylinder, sphere, etc.) surface characteristics (smooth, rough, irregular, etc.) and number to be dispensed (one or more than one). The article dispenser, in turn, must accommodate these peculiarities if it is to be effective.

It is often necessary to dispense flat sheet-like articles, such as panels of cloth, plastic, paper or similar materials. Such material panels may be used as wipes, napkins, dust covers, doilies, mats, tray covers, place mats or for like purposes. While sometimes it is necessary to obtain a number of such panels at other times it is just as desirable to get but a single discrete panel.

However, hand removal of single sheet panels, such as place mats, from a container holding a stack of such panels may prove time consuming and wasteful if the panels stick together and more then one is removed and used when it is only desired to get a single panel. Or, if a number of panels are, in fact, desired they will have to be hand counted and separated. If the panels are made of a material treated to increase washability, or to facilitate keeping the panel, or place mat, in place or the items to be placed on the mat from slipping, then hand removal of one or a particular number of panels from the container may prove even more difficult. Machine dispensing of individual ones or a particular number, of such single panels, when stacked one upon the other in a container, may also present difficulties; especially if the panels have one or more treated surfaces. Automated or semi-automated equipment for sheet feeding of individual sheets of such panel-like place mats, particularly surface treated mats, may necessitate relatively complex and costly mechanisms. Complexities and costs which may not offset by the type of panel to be dispensed, or the purpose for which the panels are to be used.

Dispensing of panels of material may be facilitated by formimg the material into a web and providing same in roll form. A commonly available form of dispenser for such rolled webs is a container which rotatively mounts the roll so that the material can be pulled by an end and torn off from the remainer of the roll against a sharp edge on the container. Such containers are exemplified by those shown in U.S. Pat. No. 2,957,738 granted on Oct. 25, 1960 to M. M. Marcuse for Dispensing Device For Roll Material and in U.S. Pat. No. 3,190,520 granted on June 22, 1965 to G. W. Wyant for Cutter For Non-Woven Fabric Towel Dispensers. But it is difficult in such dispensers to be assured that each panel of material will be the same length or will sever from the next piece of material along a straight line.

Dispensing of such panels and separating of the panels, one from the other, when in roll form, is further facilitated by forming the web so that each panel is separated, and severable, from adjacent panels by perforations, formed across the width of the web. The regularly spaced perforations theorectically should assure panels of uniform size each cleanly severed from its adjacent panels. But sometimes the force applied to the end of the web to tear off a panel pulls out a second panel or tears the panel at a location other than along the perforations. This, of course, wastes material or results in dispensing of unwanted panels.

The availability of automatic dispensers for panel like items, such as place mats, in roll form with perforations separating each panel on the roll, has proved to be lacking of equipment which is efficient and at a cost commensurate with the value of the articles to be so dispensed.

SUMMARY OF THE INVENTION

It is therefore an object of this invention to provide a new and improved article dispenser.

It is another object of this invention to provide a new and improved dispenser for sheet-like articles.

It is yet another object of this invention to provide a novel and improved automatic dispenser for dispensing single sheet-like panels from a roll of such panels.

It is still another object of this invention to provide a novel and improved automatic dispenser for plate mats.

It is yet still another object of this invention to provide a novel and improved automatic dispenser for dispensing single ones of place mats from a roll of such place mats.

It is yet still a further object of this invention to provide a new and improved automatic dispenser for dispensing surface treated place mats, one by one, from a roll of such place mats.

This invention involves article dispensers, and contemplates: forming the dispenser to mount a roll of place mats, or similar panels of material, in a position for rotation about a predetermined axis of rotation, and so that as the end place mat is severed and withdrawn from the roll a dispensing drive will automatically advance the web of material until another place mat is in position, to be so severed and withdrawn, and when so positioned the position of the leading place mat will be sensed and the dispensing drive discontinued and a tension drive actuated, to provide a tensioning force to the web of material to facilitate severing but a single place mat from the roll.

Other objects, features, and advantages of the invention in its details of construction and arrangement of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

In the present invention, an article dispenser is provided in which a lazy-susan type roll table supports, in a vertical position, a roll of place mats interconnected into a continuous web (i.e., each mat is attached to its adjacent mat by perforations and all are rolled up on a core to form the roll of material). A web feed roller, also disposed for rotation about a vertical axis, is spaced from the roll table and cooperates with a pinch roller to grip therebetween the web of place mats and to feed the place mats along a path. An end panel positioning plate receives the end place mat, as the web is being fed, and carries an infra-red sensor which responds to the presence of the perforations between the mats to terminate drive of the web feed roller. A web tension drive extends up through the core of the roll of place mats and mounts a soft rubber drive wheel which when driven urges the web roll in a direction opposite to that imparted to the web by the web feed roller. Control circuitry actuates the tension drive when web feed drive terminates to apply tension to the web and facilitate severing of the end place mat, from the other place mats, along the perforations when the end place mat is positioned at the end panel. The end panel also carries a micro-switch which senses the absence of the just separated end place mat to terminate power to the tension drive and start web feed drive to repeat the process of positioning a place mat at the end panel. A jogging switch is provided to facilitate short web advancing operations of the web feed and an oscillator is provided to adjust the length of advance of the web to thereby compensate for different size place mats.

The present invention is characterized by the provision of an article dispenser including base means; rotary table means carried by the base means for rotation about a first predetermined axis of rotation; the rotary table means being of a size and configuration to support a web of material in roll form and with the axis of rotation of the web material roll disposed substantially colinear with the first predetermined axis of rotation; roll drive means carried by the base means and disposed for coaction with a web material roll, when supported by the rotary table means, to urge the web of material in a first predetermined direction; web feed means, carried by the base means, and disposed for coaction with the web material, as it is unwound from the web material roll, to feed same along a web path; web end positioning means, carried by the base proximate a portion of the web path and for coaction with the web of material to position an end portion of the web of material in a predetermined position; first sensing means disposed proximate the web path and for coaction with the web of material, and responsive to a first characteristic of the web of material to provide a first output signal, and to a second characteristic of the web of material to provide a second output signal; second sensing means disposed proximate the web end positioning means responsive to the presence of a portion of the web material to provide a first output indication and to the absence of a portion of the web material to provide a second output indication; and control means response to the first and the second input signals from the first sensing means and the first and the second input indications from the second sensing means, and coacting with the web feed means and the roll drive means to effect feed of the web of material along the web path when the second sensing means provides the second output indication and the first sensing means provides the second output signal and to arrest feed of the web of material with an end portion thereof disposed by the web end positioning means when the first sensing means provides the first output signal; the second sensing means providing the first output indication when the end of the web of material is so positioned by the web end positioning means.

In a preferred embodiment of the present article dispenser, the web of material consists of individual place mats interconnected into a web and disposed on a roll, and the first characteristic of the web of material is a line of perforations partially separating adjacent place mats on the web; while the second characteristic of the web of material is a lack of such perforations. In this case, typically the positioning means positions a single place mat for removal from the web of material, and generally the first sensing means senses the presence or absence of the web perforations. Usually in this case the second sensing means is a micro-switch with a sensing clip that is urged into the web path and moved therefrom by the presence of the web of material in the web path at said web end positioning means.

In one embodiment of the present article dispenser, the roll drive means is actuated when the second sensing means provides the first output indication to urge the web roll in the first predetermined direction, and the first predetermined direction is opposite to the direction of web feed along the web path; the roll drive means coacting with the web of material and the web feed means to put the web of material in tension. In this case, typically the article dispenser includes roll drive means which includes motor means carried by the base means, and motor shaft means extending from the base means though an opening formed in the table means; the roll drive means further including a drive wheel disposed on the motor shaft and engageable with the roll of material, to urge the roll of material to rotate, so as to urge the web of material in the first predetermined direction. Generally the drive wheel is formed of foam rubber, and the drive wheel is disposed for coaction with the core about which the web of material is rolled.

Typically the web feed means includes a power unit carried by the base means and web feed roller means for coaction with the power unit feed means, the web feed roller means including a surface disposed proximate the web path. In this case, generally the web feed means also includes a pinch roller disposed proximate the web path and urged by spring means to move against a web of material when moving along the web path, to move the web of material against a surface of the web feed roller means. Preferably the web feed roller means and the pinch roller are each disposed for rotation about vertical axis of rotation in parallel to the other, and the first guide means is provided proximate the web feed roller means, to urge the web of material thereagainst. Usually in this case, the first guide means includes a plurality of guide rods disposed in vertical spaced relationship, one with respect to the other, and each formed with a portion thereof of a configuration corresponding to the surface of the web feed roller means.

Preferably, the web end positioning means includes a positioning plate carried by the base means, and a guide rod extending along the positioning plate and being urged toward the positioning plate, to position therebetween an end portion of the web of material. In one embodiment and typically, the control means includes jogging means coacting with the web feed means, to actuate the web feed means for short time intervals, to thereby advance the web of material along the web path a short distance. In this case, generally the control means includes oscillator means, selectively settable to control the extent of feed of the web of material along the web path.

The invention accordingly consists in the features of construction, combination of elements, and arrangement of parts which will be exemplified in the device and article of manufacture herein after described, and of which the scope of application is as elucidated supra and as will be indicated in the appended claims. In this regard, numerous alternatives within the scope of the present invention, besides those alternatives, preferred embodiments or modes of practicing the invention mentioned supra, and those to be elucidated infra, will occur to those skilled in the art.

BRIEF DESCRIPTION OF THE DRAWING

In the drawing:

FIG. 5 is an elevational view of the dispensing roll portion of the article dispenser taken on line 5—5 of FIG. 3.

FIG. 6 is a partial sectional view taken on line 6—6 of FIG. 4.

DESCRIPTION OF THE PREFERRED EMBODIMENT

For convenience, the invention will be described as applied to an article dispenser for dispensing surface treated place mats one by one from a roll of such plate mats; it being understood, nevertheless, that without departing from the scope of this invention that the place mats need not be surface treated and, in fact, that the articles to be dispensed need not have to be place mats at all.

Figure 1:
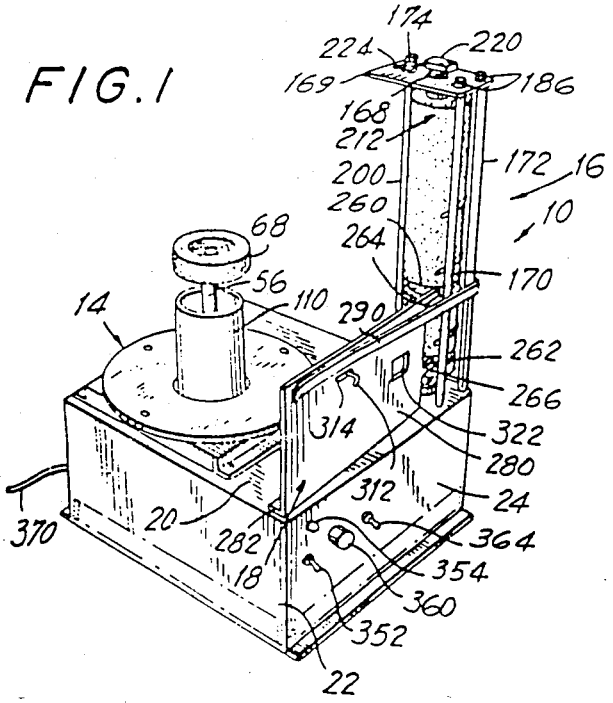
FIG. 1 is a perspective showing of an article dispenser incorporating the instant invention, but without a roll of material to be dispensed mounted thereon so as to better show details of the dispenser.
Figure 2:
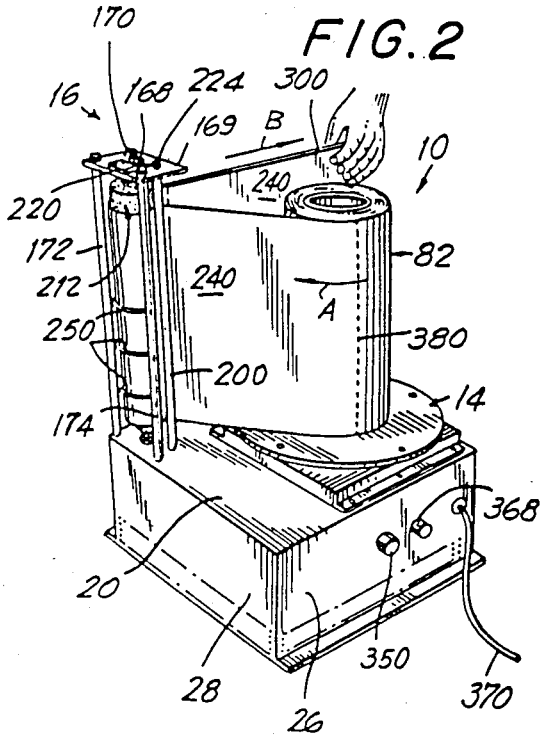
FIG. 2 is a perspective view of the article dispenser of FIG. 1 showing the other sides thereof and with a roll of material to be dispensed positioned thereon.
Figure 3:
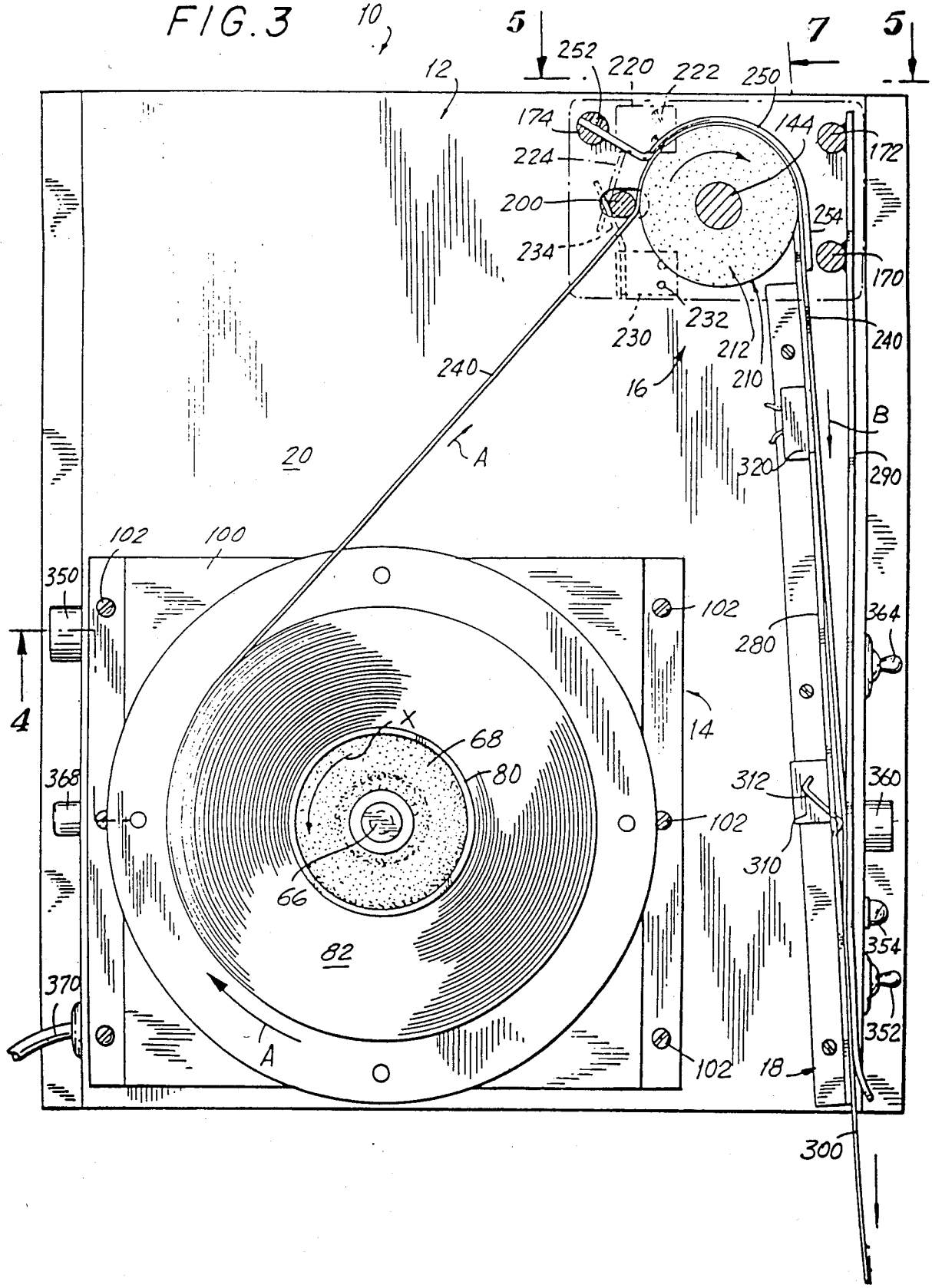
FIG. 3 is a plan view of the article dispenser of FIG. 2 enlarged to better show details thereof.

With reference to FIGS. 1-3, there is generally shown at 10 an article dispenser including a dispenser base 12, a roll table or roll holder 14, a web drive assembly 16 and an end panel positioning station 18.

Figure 4:
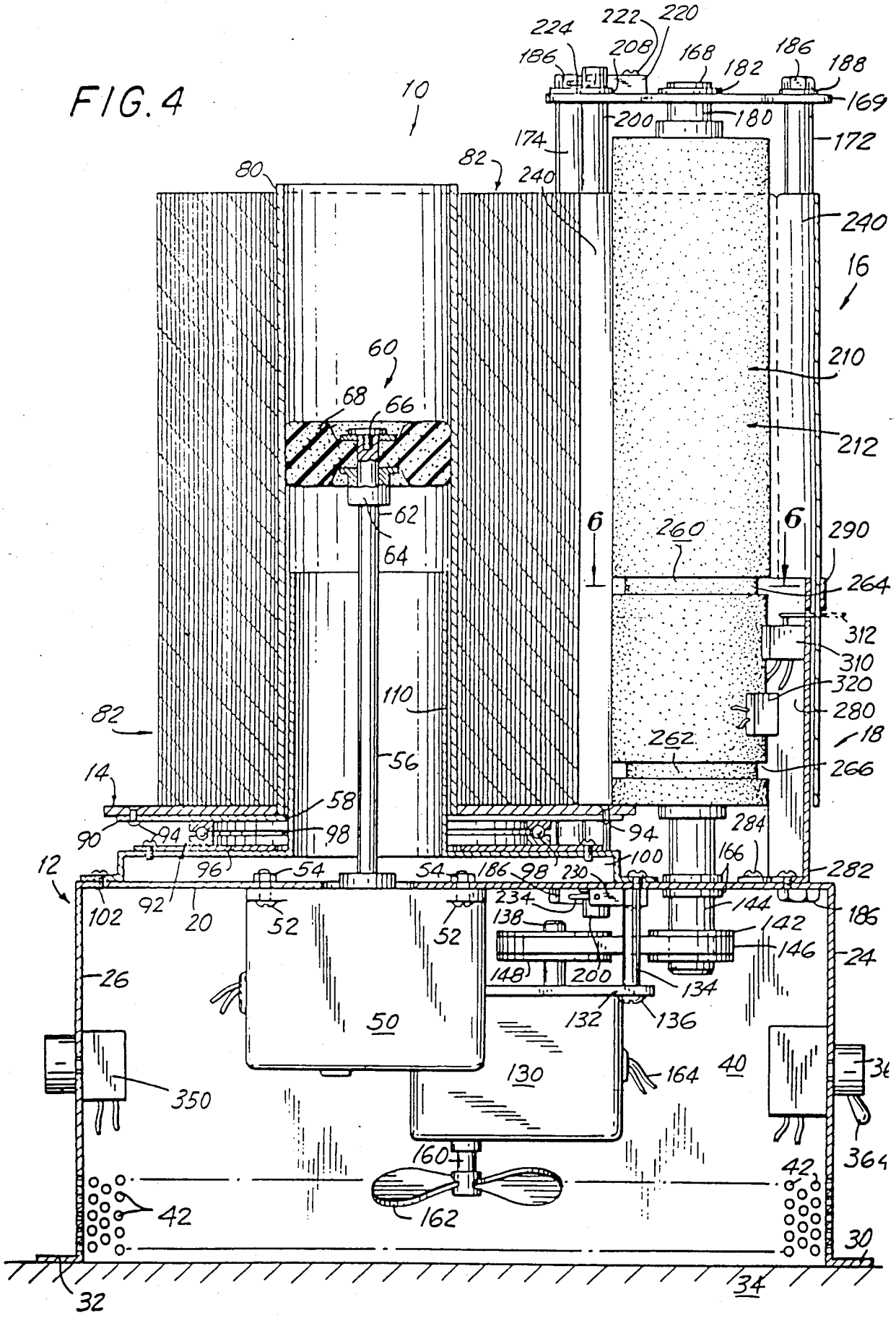
FIG. 4 is a sectional view of the article dispenser taken on line 4—4 of FIG. 3.

Dispenser base 12 includes a horizontally disposed top 20 (FIGS. 1, 2 and 4) secured to and supported by vertically disposed walls 22 (FIG. 1), 24 (FIGS. 1 and 4), 26 FIGS. 2 and 4) and 28 (FIG. 2). A pair of lips 30, 32 (FIG. 4) extend out from walls 24, 26 respectively to facilitate placement of dispenser 10 on a suitable support surface 34 such as a table top, counter, or work station top, and/or the attachment thereto by appropriate securing means such as bolts, screws or the like. Preferably one of the vertical walls, such as wall 26, is secured to the adjacent vertical walls by releasable securing means such as screws, bolts, or the like to facilitate removal therefrom for access into a component space 40 (FIG. 4) formed beneath top 20 and within walls 22, 24, 26 and 28. Alternatively, access into space 40 may be had through the open bottom of base 12. A plurality of openings 42 are formed through one or more of walls, 22, 24, 26, 28, to enable air to be circulated through component space 40 to cool the components disposed therein.

A tension motor 50 (FIG. 4) is secured in position in space 40 by bolts 52 and nuts 54 and so that a tension drive shaft 56 extends up from motor 50 through an opening 58 in roll table 14. A friction drive tension assembly 60, disposed at an end 62 of tension drive shaft 56, includes a mounting hub 64 carried by shaft 56 and a threaded member 66, which screws into the top of shaft 56, and which house between them a friction drive roller 68 formed from foam rubber or the like. Motor 50 is suitably connected into an electrical control circuit and to a source of power. The purpose of friction drive tension assembly 60, and its cooperation with a roll core 80 of a roll of material 82, when disposed on roll table 14, will be hereinafter explained.

Roll table 14 is suitably secured to an upper plate 90 (FIG. 4) of a rotary, lazy susan type, table 92 by rivets 94 or other suitable attaching devices. A lower plate 96, of table 92, is spaced from upper plate 90 by a suitable distance to accommodate a rotary ball bearing arrangement 90 therebetween. Lower plate 96 is secured by rivets 94 to the top of a support plate 100 attached by threaded members 102 to top 20 of base 12. A mounting cylinder 110 having its lower end secured to lower plate 96 extends upwardly therefrom and through opening 58 of table 14. Cylinder 110 cooperates with core 80 of roll 82 to center roll 82 on table 14.

A web drive power unit 130 (FIG. 4), also disposed in component space 40, is carried by a mounting plate 132 which is, in turn, secured in spaced relationship beneath top 20 of base 12, by a plurality of standoffs 134 and threaded members 136 (only one of each shown). A first shaft 138 extends up from unit 130 and mounts a pulley 140 which transmits the drive power to a similar pulley 142 secured to the lower end of a drive shaft 144, of web drive 16, by a timing belt 146.

A second shaft 160 extends out from power unit 130 and mounts a fan blade 162 so that when fan blade 162 is driven it will serve to cool the components in space 40. Suitable electrical wiring 164 interconnects power unit 130 into the control circuitry and to a suitable source of input power.

Drive shaft 144, transmits the power from power unit 130 to web drive asembly 16, and extends up through an opening (not shown) provided in top 20 of base 12. A bushing 166 carried by base 12 facilitates mounting drive shaft 144 to base 12. An upper end 168 of drive shaft 144 is rotatively disposed in an upper support plate 169 mounted in spaced relationship to top 20 of base 12 by three support rods 170 (FIGS. 1, and 3), 172 (FIGS. 1-5) and 174 (FIGS. 2, 4 and 5). Upper end 158 of drive shaft 144 is formed with a reduced diameter for a predetermined length so as to form a shoulder 180 (FIG. 4) upon which upper support plate 169 rests. A bushing 182, or other suitable means, rotatively receives upper end 158 of shaft 144.

Bolts 186 (only two shown in FIG. 4) extending up through openings (not shown) formed through top 20 of base 12, and are each threaded into the lower ends of support rods 170, 172, and 174 to secure them to base 12. Similar bolts 186 (FIG. 1) extend through suitable openings formed through upper support plate 169 and are threaded into upper ends of support rods 170, 172, and 174 to secure rods 170, 172, 174 and plate 169 in position. Washers, 188 (FIGS. 4 and 5) are disposed between the heads of bolts 186 and support plate 169.

A pinch roller 200 (FIGS. 2, 3, 5 and 6) is also mounted between upper support plate 169 and top 20 of base 12. An elongated slot 202 (shown in phantom in FIG. 3) is formed through plate 169 to receive one end of a roller 200; and a similar elongated slot 204 (FIG. 6) is formed through top 20 to receive the other end of roller 200. Each end of pinch roller 200 is disposed in a bearing 208 (only one shown in FIG. 4) which are mounted to slide in their respective elongated slots 202, 204 while permitting rotation of pinch roller 200 therewithin. Thus pinch roller 200 can rotate about a vertical axis through its center while its surface can move towards or away from the surface 210 of a hard rubber web drive roller 212 carried by web drive shaft 144.

A spring block 220 (FIGS. 3 and 5) is secured beneath upper support plate 169 by a pair of threaded members 222 (FIG. 3); and carries a spring 224, formed from wire rod, and which has an end that engages pinch roller 200, proximate its end near support plate 169, to urge pinch roller 200 towards drive roller 212. A second spring block 230 (FIGS. 3, 5 and 6) is secured to top 20 of base 12 by a pair of threaded members 232 (FIG. 6); and carries a spring 234, formed from wire rod and which has an end that engages pinch roller 200, proximate its end near base 12, to urge pinch roller 200 towards drive roller 212. Thus, springs 224, 234 urge the surface of pinch roller 200 towards surface 210 of roller 212 and by doing so urge the web 240 of material from roll 82 against surface 210 of roller 212 to be driven thereby in the direction of arrow A (FIG. 3) as will be hereinafter explained in more detail.

Web 240 is guided around roller 212 by three paper guides 250 (FIGS. 2, 3 and 5) each formed of steel wire and each having one end inserted into a suitable hole formed in support rod 174 and secured in place by a threaded member 252 (FIG. 3). The other end of each paper guide 250 is formed to proximate the contour of surface 210 of web drive roller 212 and to terminate at a free end 254 directing web 240 in the direction of arrow B from roller 212 towards end panel positioning station 18.

A pair of grooves 260, 262 (FIG. 4) are formed in roller 212 proximate the lower end thereof to receive projections 264, 266 respectively (FIGS. 1 and 4) formed on one end of a panel positioning plate 280. A lip 282 extends out from plate 280 along the button edge thereof to facilitate attachment of plate 280 to top 20 of base 12 as by threaded members 284 (FIG. 4). A guide bar 290 (FIGS. 1 and 3), carried by support rods 170, 172 and extending in the direction of plate 280, urges web 240 against plate 280 to position an end panel 300 (FIG. 7) of web 240 at end panel station 18.

A micro-switch 310 (FIGS. 3 and 4) is carried by plate 280 so that an end panel sensor clip 312, carried by micro-switch 310, can extend through a slot 314 (FIG. 1) formed in plate 280. An infra red perforation sensor 320 (FIG. 3) is also carried by plate 280 so as to coact, through a window 322 (FIG. 1) formed through plate 280 with the perforations dividing one panel 300 from its adjacent panel 300 of web 240. Micro-switch 310, and infra-red sensor 320 are all connected together into the electrical control circuit for dispenser 10.

The electrical circuit for dispenser 10 includes an ocillator 350 (FIGS. 2 and 4) adjustable to control the feed of web drive 16 according to the size (length) of the panel 300. Also provided in the electrical control circuit is a conventional on/off switch 352, and an indicator light 354 to show when dispenser 10 is on. A jogging switch 360 (FIGS. 3 and 4) is included in the electrical circuit and for cooperation with web feed drive 16 to advance a panel 300 of web 240 in small increments if need be. A size selector switch 364 is also electrically wired into the electrical circuit. A fuse 368 (FIGS. 2 and 3) accessible at wall 26 of base 12 is included in the electrical circuit for conventional reasons and an electrical conductor 370 of the electrical circuit extends out from base 12 to connect the electrical circuit of dispenser 10 to a suitable source of electrical power.

Web 240 is made up of a number of individual panels 300 which may be utilized for any intended purpose. Panels 300 may be wipes, or they may be conventional type place mats. In this preferred embodiment panels 300 are place mats whose surfaces are specially treated to facilitate disposition of the place mat in a tray, or on the surface of a fold down table, of the type utilized in airplanes. The surface treatment of place mats 300 can be such that slippage of mat 300 on the tray surface is minimized; and slippage of items placed upon mat 300 will also be minimized. The surface treatment may also serve to minimize damage to place mat 300 from spilled liquids.

Place mats, or panels, 300 are formed from the continuous web of material 240, and individualized one with respect to the other, by forming lines of perforations or cuts 380 (FIGS. 2 and 7) through web 240. Web 240 is rolled onto a core of cardboard or the like during its manufacture.

In use roll 82 of place mats 300 is disposed on table 14 with its core 80 positioned about mounting cylinder 110. The end of web 240 is threaded (in the direction of arrow A-FIG. 3) between pinch roller 200 and web feed drive roller 212, around roller 212 so as to be held thereagainst by paper guides 250, and in the direction of arrow B (FIG. 3) along the surface of end panel positioning plate 280 to be held thereagainst by paper guide rod 290. Perforations 380 should be somewhat aligned with infra-red sensor 320. If need be jogging switch 360 can be utilized to advance end panel 300 into position.

Figure 7:
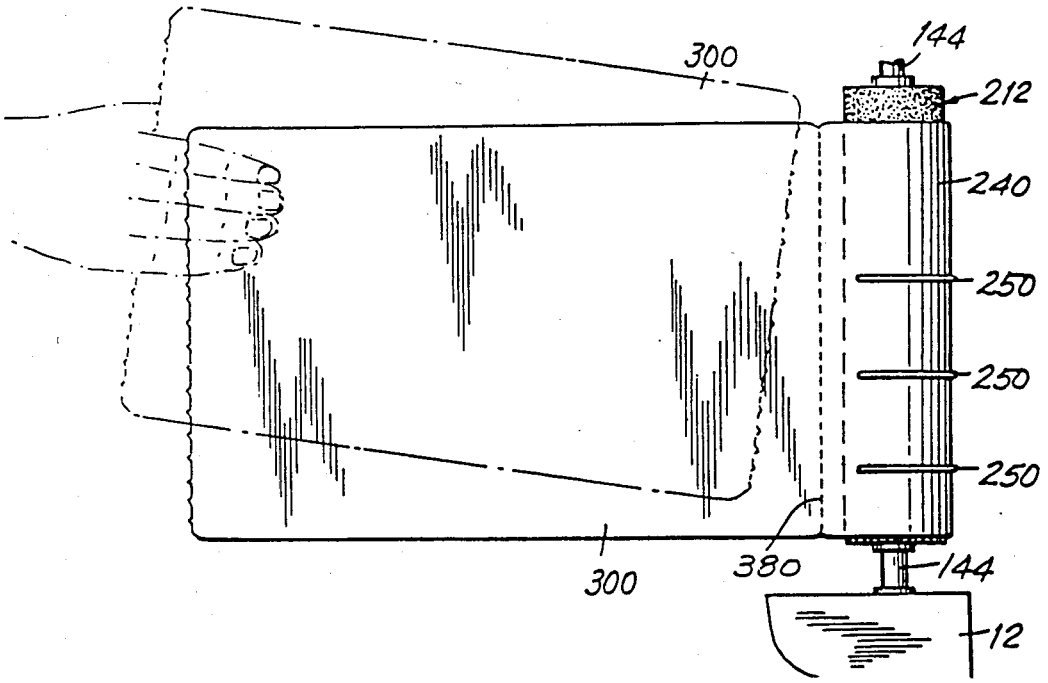
FIG. 7 is a schematic elevational view showing a place mat being severed from the end of a roll of material.

With on/off switch 352 actuated to turn on the electrical circuit, and indicator light 354 indicating that such has happened, article dispenser 10 is ready for use. The end place mat 300 may then be grasped (as shown in FIG. 7) and separated from the rest of web 240 by tearing along the line of perforations 380. During such removal of end panel 300 the power to web feed drive 16 is turned off but power to web tension motor 50 is on and motor 50 through its shaft 56 is driving friction drive roller 68 in the direction of arrow "X" (FIG. 3). This applies a pull to web 240 in a direction opposite to arrows A and B and maintains web 240 under tension to facilitate severing end panel 300 from the rest of the web 240.

After end place mat 300 has been severed micro-switch sensor clip 312 will be permitted to move further out through slot 314 due to the absence of a place mat 300 against panel 280. The movement of clip 312 will actuate micro-switch 310 to turn off tension drive 50 and turn on power unit 130 to transmit its drive through shaft 138, pulley 140, timing belt 146, pulley 142, and drive shaft 144 to web drive roller 212. The coaction of web drive roller 212 and pinch roller 210 will draw web 240 around drive roller 212, feed web 240 between paper guides 250 and roller 212, and out along plate 280. Guide rod 290 will hold the new end panel 300 against plate 280.

When infra-red sensor 320 senses perforations 380 the power to power unit 130 will be cut off terminating the operation of web feed drive 16 and further movement of web 240. Concurrently therewith power input to tension motor 50 will be initiated and tension applied to web 240 as previously explained. If drive to web 240 is inadvertently terminated before an end place mat 300 is in position to be severed, or if continuous operation is not desired, then jogging switch 360 may be actuated to move the end place mat 300 into position to be removed from roll 82. Removal of end place mat 300 will again initiate feed of web 240.

From the above description it will thus be seen that there has been provided a novel and improved article dispenser, particularly for webs of discrete sheet shock items such as place mats interconnected by lines of severance; which dispenser while relatively simple in construction and operation, feeds the web of discrete items along a predetermined path, in an automated manner, so that as an end panel of the web is removed the web advances to place another end panel in position to be readily removed.

It is understood that although I have shown the preferred form of my invention that various modifications may be made in the details thereof without departing from the spirit as comprehended by the following claims.

It thus will be seen that there is provided an article dispenser device, and article of manufacture, which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

I claim:

1. An article dispenser; comprising:

(a) base means;

(b) rotary table means carried by said base means for rotation about a first predetermined axis of roation;

(c) said rotary table means being of a size and configuration to support a web of material in roll form and with the axis of rotation of the web material roll disposed substantially co-linear with said first predetermined axis of rotation;

(d) roll drive means carried by said base means and disposed for coaction with a web material roll, when supported by said rotary table means, to urge the web of material in a first predetermined direction;

(e) web feed means, carried by said base means, and disposed for coaction with the web material, as it is unwound from the web material roll, to feed same along a web path;

(f) web end positioning means, carried by said base proximate a portion of said web path and for coaction with the web of material to position an end portion of the web of material in a predetermined position;

(g) first sensing means disposed proximate said web path and for coaction with the web of material, and responsive to a first characteristic of the web of material to provide a first output signal, and to a second characteristic of the web of material to provide a second output signal;

(h) second sending means disposed proximate said web end positioning means responsive to the presence of a portion of the web material to provide a first output indication and to the absence of a portion of the web material to provide a second output indication; and (i) control means response to said first and said second output signals from said first sensing means and said first and said second output indications from said second sensing means, and coacting with said web feed means and said roll drive means to effect feed of the web of material along said web path when said second sensing means provides said second output indication and said first sensing means provides said second output signal and to arrest feed of the web of material with an end portion thereof disposed by said web end positioning means when said first sensing means providies said first output signal;

(j) said second sensing means providing said first output indication when the end of the web of material is so positioned by said web end positioning means.

2. The article dispenser of claim 1, wherein the web of material consists of individual place mats interconnected into a web and disposed on a roll and the first characteristic of the web of material is a line of perforations partially separating adjacent place mats on the web; while the second characteristic of the web of material is a lack of such perforations.

3. The article dispenser of claim 2, wherein said web end positioning means positions a single place mat for removal from the web of material.

4. The article dispenser of claim 3, wherein said first sensing means senses the presence or absence of the web perforations;

5. The article dispenser of claim 4, wherein said second sensing means is a micro-switch with a sensing clip that is urged into the web path and moved therefrom by the presence of the web of material in the web path at said web end positioning means.

6. The article dispsenser of claim 1, wherein said roll drive means is actuated when said second sensing means provides said first output indication to urge the web roll in said first predetermined direction, and said first predetermined direction is opposite to the direction of web feed along the web path; said roll drive means coacting with the web of material and said web feed means to put the web of material in tension.

7. The article dispenser of claim 6, wherein said roll drive means includes motor means carried by by said base means and motor shaft means extending from said base means through an opening formed in said table means, said roll drive means further including a drive wheel disposed on said motor shaft and engageable with the roll of material to urge the roll of material to rotate so as to urge the web of material in said first predetermined direction.

8. The article dispenser of claim 7, wherein said drive wheel is formed of foam rubber.

9. The article dispenser of claim 8, wherein said drive wheel is disposed for coaction with the core about which the web of material is rolled.

10. The article dispenser of claim 1, wherein said web feed means includes a power unit carried by said base means and web feed roller means for coaction with said power unit feed means, said web feed roller means including a surface disposed proximate said web path.

11. The article dispsenser of claim 10, wherein said web feed means also includes a pinch roller disposed proximate said web path and urged by spring means to move against a web of material when moving along the web path, to move the web of material against a surface of said web feed roller means.

12. The article dispenser of claim 11, wherein said web feed roller means and said pinch roller each disposed for rotation about vertical axis of rotation in parallel to the other.

13. The article dispenser of claim 12, wherein first guide means are provided proximate said web feed roller means to urge the web of material thereagainst.

14. The article dispenser of claim 13, wherein said first guide means includes a plurality of guide rods disposed in vertical spaced relationship one with respect to the other and each formed with a portion thereof of a configuration corresponding to the surface of said web feed roller means.

15. The article dispenser of claim 1, wherein said web end positioning means include a positioning plate carried by said base means and a guide rod extending along said positioning plate are being urged toward said positioning plate to position therebetween an end portion of the web of material.

16. The article dispenser of claim 1, wherein said control means includes jogging means coating with said web feed means to actuate said web feed means for short time intervals to thereby advance the web of material along said web path a short distance.

17. The article dispenser of claim 16, wherein said control means includes oscillator means selectively settable to control the extent of feed of the web of material along said web path.

* * * * *